US007163043B2

(12) United States Patent
Huang

(10) Patent No.: US 7,163,043 B2
(45) Date of Patent: Jan. 16, 2007

(54) VERTICAL WINDOW BLIND WITH A DECORATIVE CURTAIN

(76) Inventor: Tai-Long Huang, No. 382, Yuan-Lu Rd., Sec. 1, Fuhsing, changhua (TW)

( * ) Notice: Subject to any disclaimer, the term of this patent is extended or adjusted under 35 U.S.C. 154(b) by 140 days.

(21) Appl. No.: 11/001,086

(22) Filed: Dec. 2, 2004

(65) Prior Publication Data

US 2006/0118249 A1 Jun. 8, 2006

(51) Int. Cl.
*E06B 9/262* (2006.01)

(52) U.S. Cl. ..... 160/89; 160/84.04; 160/900

(58) Field of Classification Search ..... 160/89, 160/84.01, 84.04, 84.05, 168.1 V, 173 V, 160/348, 900; 24/716
See application file for complete search history.

(56) References Cited

U.S. PATENT DOCUMENTS 3,844,330 A * 10/1974 Hyman ..... 160/168.1 V
3,851,699 A * 12/1974 Shapiro ..... 160/168.1 V
4,291,738 A * 9/1981 Grenga et al. ..... 160/176.1 R
5,012,552 A * 5/1991 Wulf ..... 16/87.4 R
5,297,607 A * 3/1994 Beauchamp ..... 160/84.04
5,339,883 A * 8/1994 Colson et al. ..... 160/84.05
6,098,246 A * 8/2000 Moir ..... 16/87.2
6,186,213 B1 * 2/2001 Senesac ..... 160/89
6,334,477 B1 * 1/2002 Moir ..... 160/168.1 V
6,510,885 B1 * 1/2003 Shih ..... 160/89
6,675,858 B1 * 1/2004 Marocco ..... 160/89
6,786,269 B1 * 9/2004 Senesac et al. ..... 160/89
6,789,596 B1 * 9/2004 Lin ..... 160/89
2003/0051823 A1 * 3/2003 Nien ..... 160/89

* cited by examiner

*Primary Examiner*—David Purol
(74) *Attorney, Agent, or Firm*—Hunton & Williams

(57) ABSTRACT

A vertical window blind includes a headrail, a plurality of carriers, a plurality of vertical slats, a decorative curtain, and a plurality of connecting devices. The curtain includes a curtain body having a plurality of mounting portions and covering portions that are alternately arranged along a longitudinal direction of the headrail. Each of the connecting devices includes a first connecting unit disposed at a respective one of the carriers, and a second connecting unit disposed at a respective one of the mounting portions of the decorative curtain and connected removably to the first connecting unit. Gaps between the slats are completely screened by the covering portions of the decorative curtain.

2 Claims, 8 Drawing Sheets

VERTICAL WINDOW BLIND WITH A DECORATIVE CURTAIN

BACKGROUND OF THE INVENTION

1. Field of the Invention

This invention relates to a vertical window blind, and more particularly to a vertical window blind that includes a decorative curtain.

2. Description of the Related Art

Referring to FIGS. 1, 2, and 3, a conventional vertical window blind is shown to include a headrail 11, a plurality of carriers 12, a plurality of vertical slats 13, and a decorative curtain 14.

The carriers 12 are disposed slidably in the headrail 11, and are slidable along a longitudinal direction (X) of the headrail 11. Each of the carriers 12 includes a rod body 121 that extends downwardly from the headrail 11 and that is provided with a retaining hook (not shown).

The decorative curtain 14 includes a top edge 141, a bottom edge 142, a left side edge 143 interconnecting the top and bottom edges 141, 142, a right side edge 144 interconnecting the top and bottom edges 141, 142 and opposite to the left side edge 143, a plurality of equidistant mounting portions 145 disposed between the left and right side edges 143, 144 and located respectively under the carriers 12, and a plurality of covering portions 146 interconnecting the mounting portions 145. The mounting portions 145 and the covering portions 146 are alternately arranged along the longitudinal direction (X) of the headrail 11.

Each of the mounting portions 145 of the decorative curtain 14 is folded to form an adjacent pair of panel portions 145' that abut respectively against two opposite side surfaces of the corresponding vertical slat 13. Each of the panel portions 145' is formed with a pair of male and female buckle pieces 147, 147' that engage respectively the female and male buckle pieces 147', 147 of the adjacent panel portion 145'.

The female buckle pieces 147' of each of the mounting portions 145 flank the rod body 121 of the corresponding carrier 12, and rest on a top edge of the corresponding vertical slat 13. As such, the gaps between the vertical slats 13 are completely screened by the covering portions 146 of the decorative curtain 14.

Because the decorative curtain 14 is hung on the vertical slats 13 by the female buckle pieces 147', the conventional vertical window blind suffers from the following drawbacks:

(1) The decorative curtain 14 cannot be mounted until the vertical slats 13 have been hung respectively on the rod bodies 121 of the carriers 12.

(2) The decorative curtain 14 is mounted to the vertical slats 13 by two of the male buckle pieces 147 and two of the female buckle pieces 147'. Thus, the mounting of the decorative curtain 14 to the vertical slats 13 is a difficult and slow process.

(3) The vertical slats 13 bear the total weight of the decorative curtain 14, and therefore are easily detached from the retaining hooks (not shown).

SUMMARY OF THE INVENTION

The object of this invention is to provide a vertical window blind that is capable of overcoming the above-mentioned drawbacks associated with the prior art.

According to this invention, a vertical window blind includes a headrail, a plurality of carriers, a plurality of vertical slats, a decorative curtain, and a plurality of connecting devices. The decorative curtain includes a curtain body having a plurality of mounting portions and covering portions that are alternately arranged along a longitudinal direction of the headrail. Each of the connecting devices includes a first connecting unit disposed at a respective one of the carriers, and a second connecting unit disposed at a respective one of the mounting portions of the decorative curtain and connected removably to the first connecting unit. Gaps between the vertical slats are completely screened by the covering portions of the decorative curtain.

Because the curtain is mounted directly to the carriers, it is not necessary to first connect the vertical slats to the carriers during mounting of the curtain. Furthermore, because the weight of the curtain is not applied to the vertical slats, undesired detachment of the vertical slats from the carriers can be prevented.

In one preferred embodiment, each of the carriers has a rod body that is formed with a hole, which constitutes the first connecting unit. Each of the mounting portions of the decorative curtain is folded to form an adjacent pair of first and second panel portions. The second connecting unit of each of the connecting devices includes a retaining pin secured to the corresponding first panel portion, and a retaining ring secured to the corresponding second panel portion. The retaining pins extend respectively through the holes in the rod bodies of the carriers, and are inserted respectively into the retaining rings so as to interconnect the decorative curtain and the carriers. Thus, the decorative curtain can be easily mounted to the carriers.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
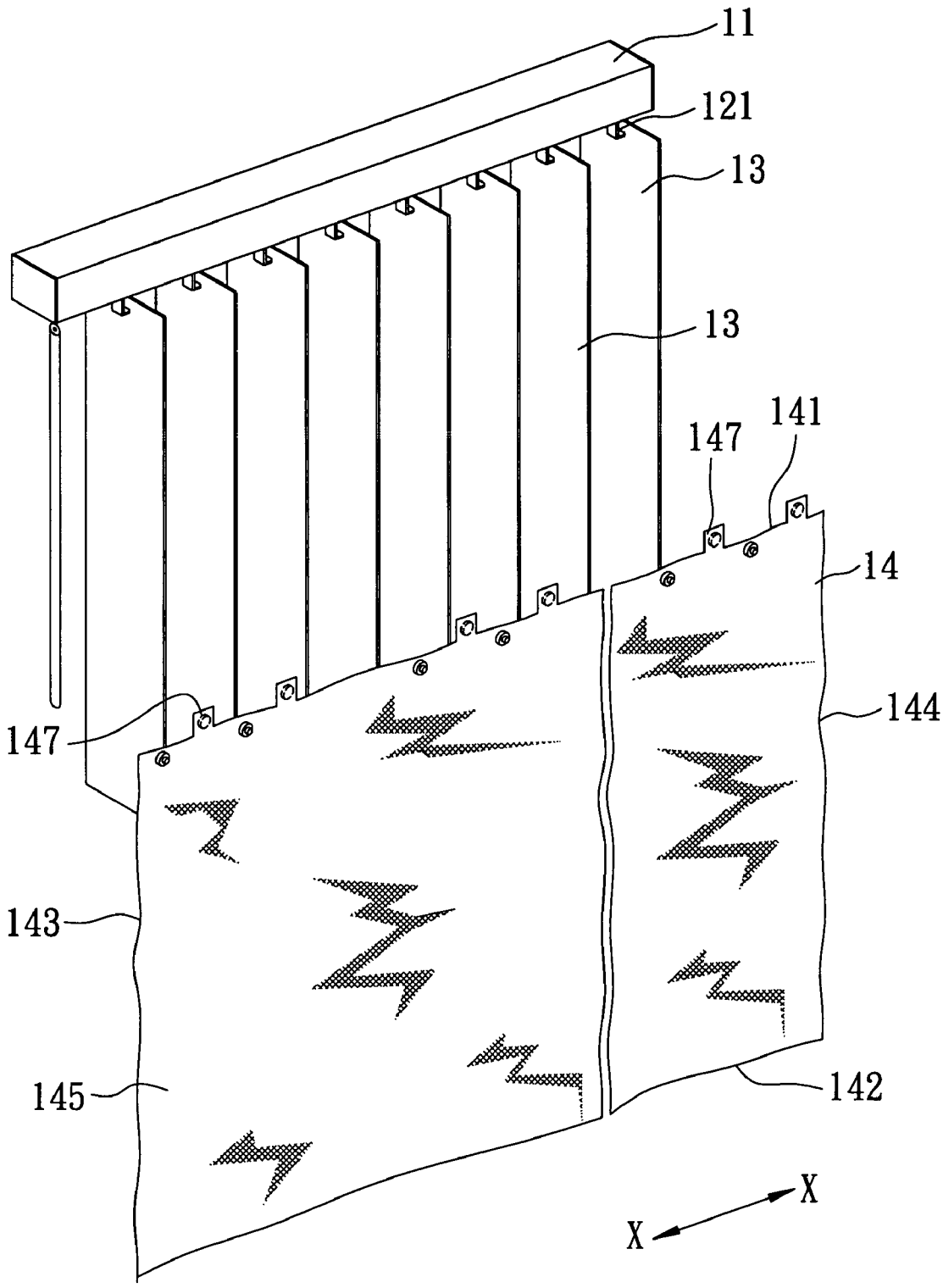
FIG. 1 PRIOR ART
FIG. 1 is a partly exploded perspective view of a conventional vertical window blind that includes a decorative curtain.
Figure 2:
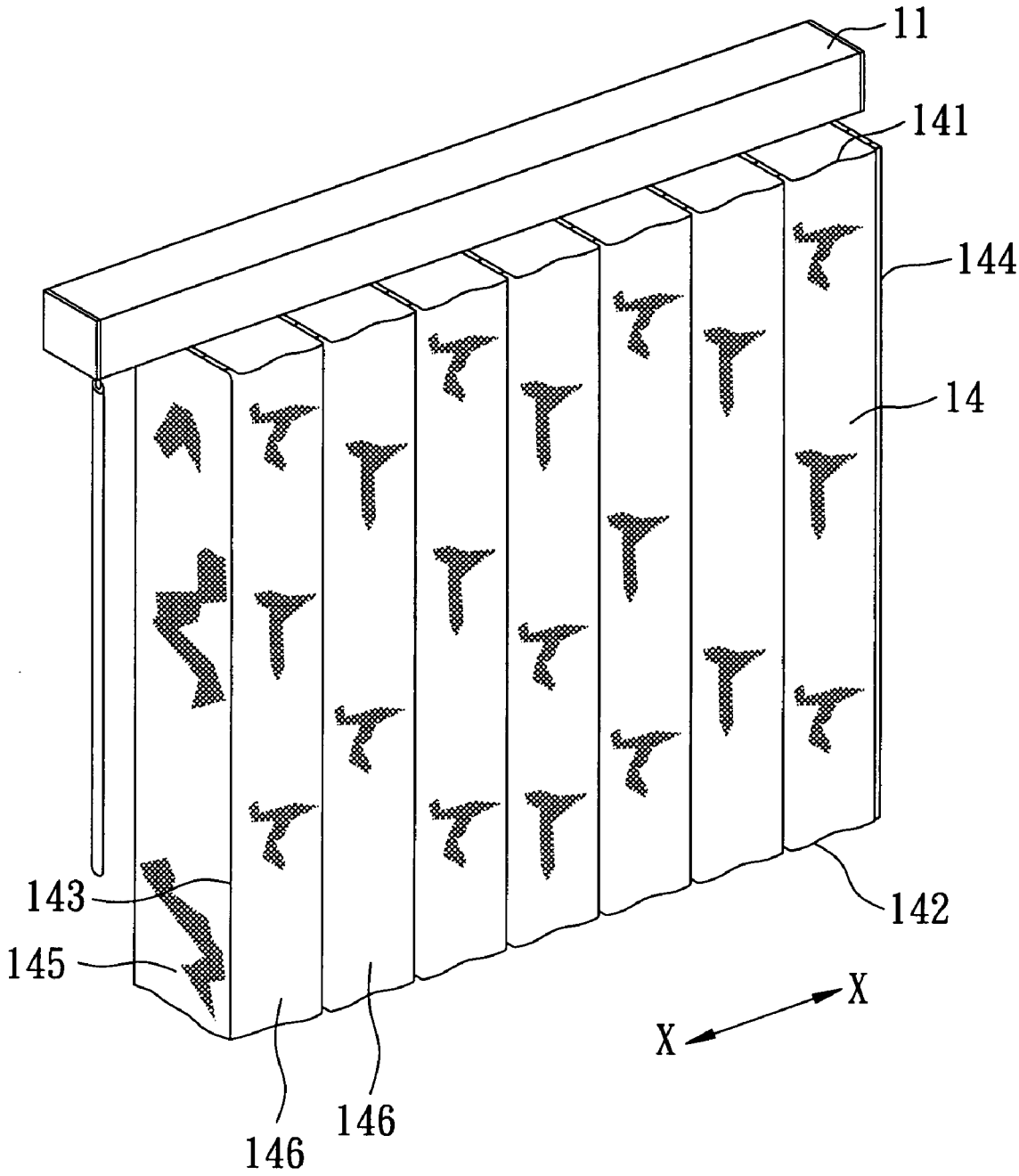
FIG. 2 PRIOR ART
FIG. 2 is an assembled perspective view of the conventional vertical window blind.
Figure 3:
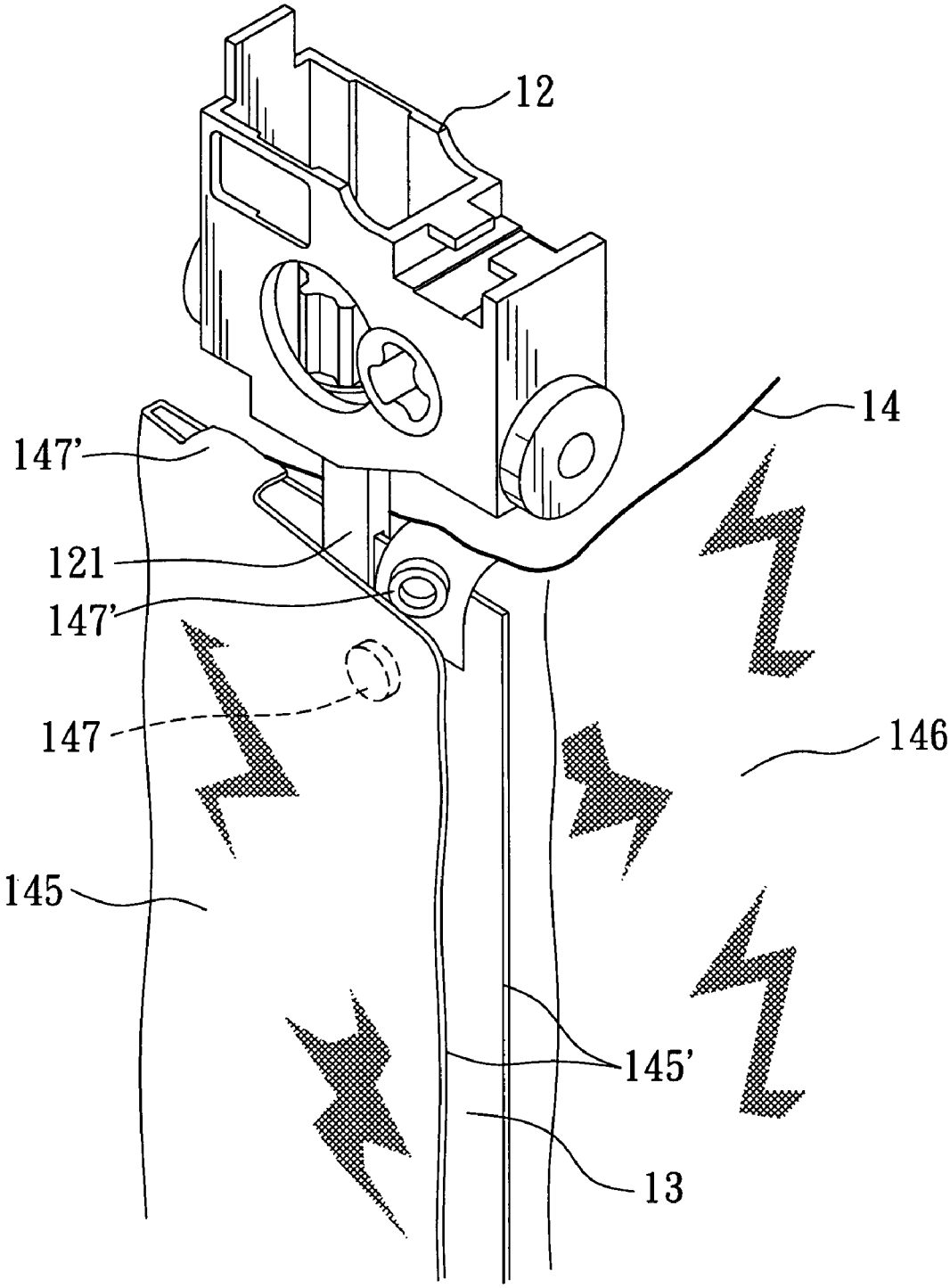
FIG. 3 PRIOR ART
FIG. 3 is a fragmentary, assembled perspective view of a carrier and a mounting portion of the decorative curtain of the conventional vertical window blind.
Figure 4:
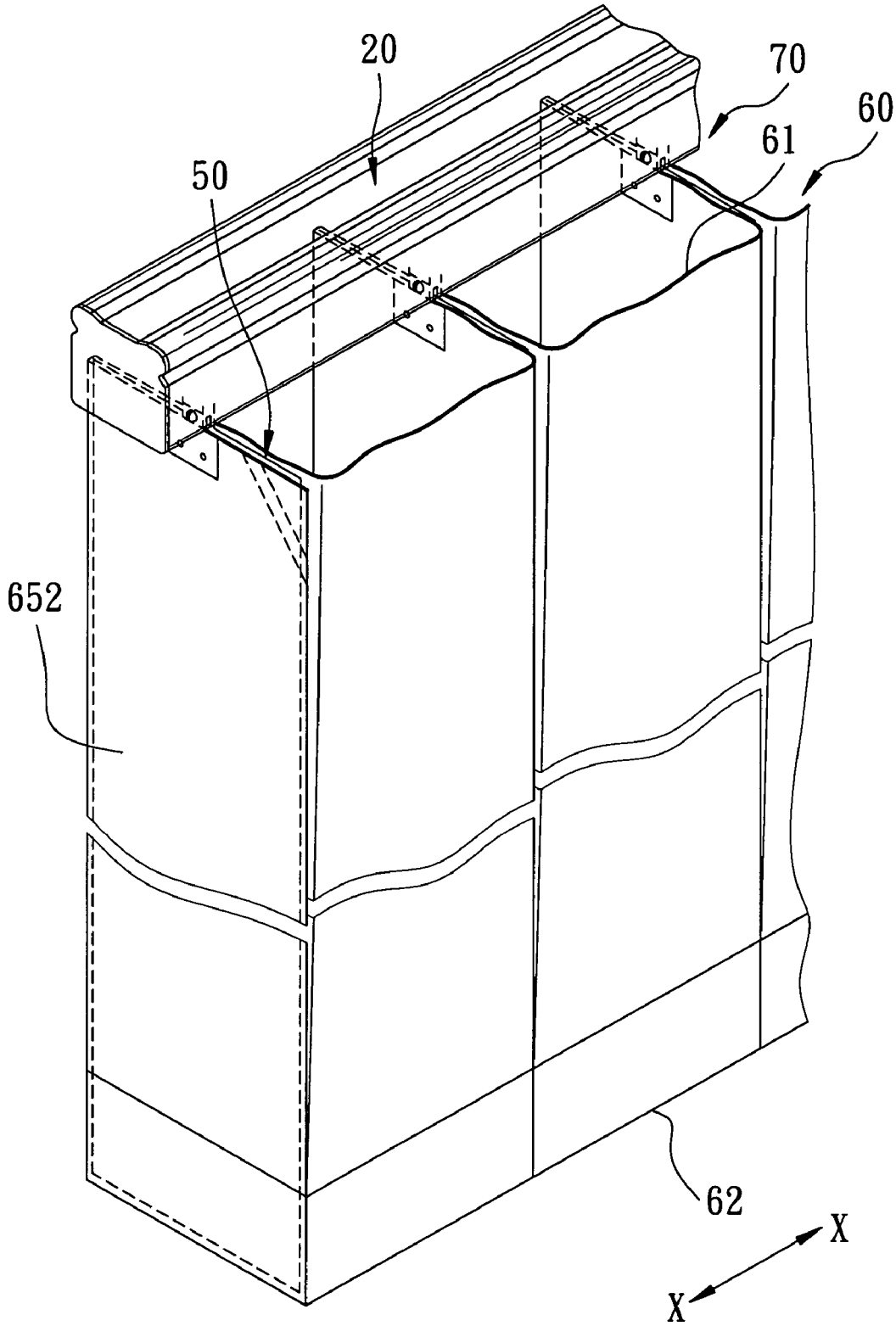
FIG. 4 is a fragmentary, assembled perspective view of the preferred embodiment of a vertical window blind according to this invention.
Figure 5:
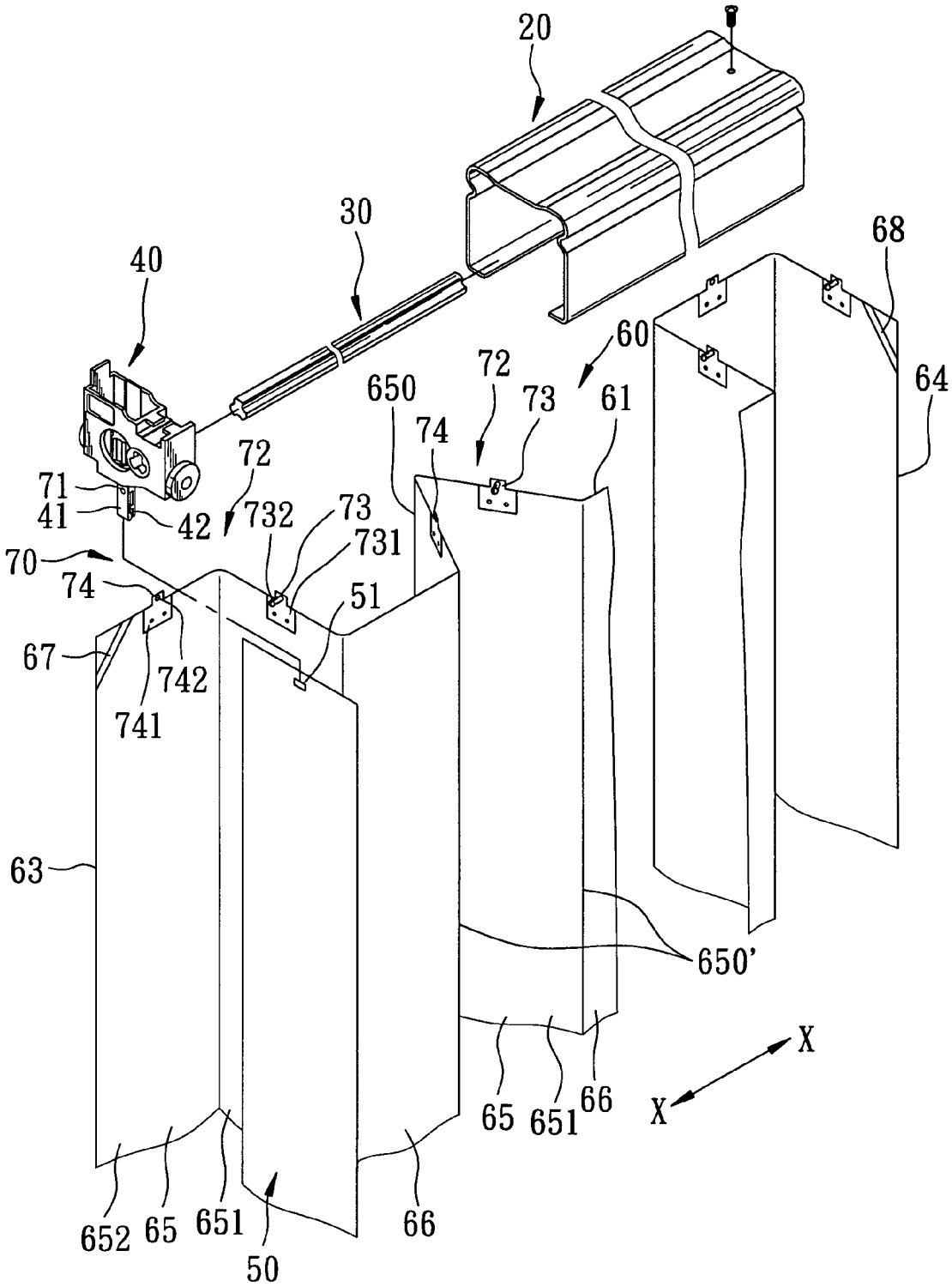
FIG. 5 is an exploded perspective view of a headrail, a carrier, a vertical slat, and a decorative curtain of the preferred embodiment, in which a portion of the headrail is removed to illustrate the interior structure of the headrail.
Figure 6:
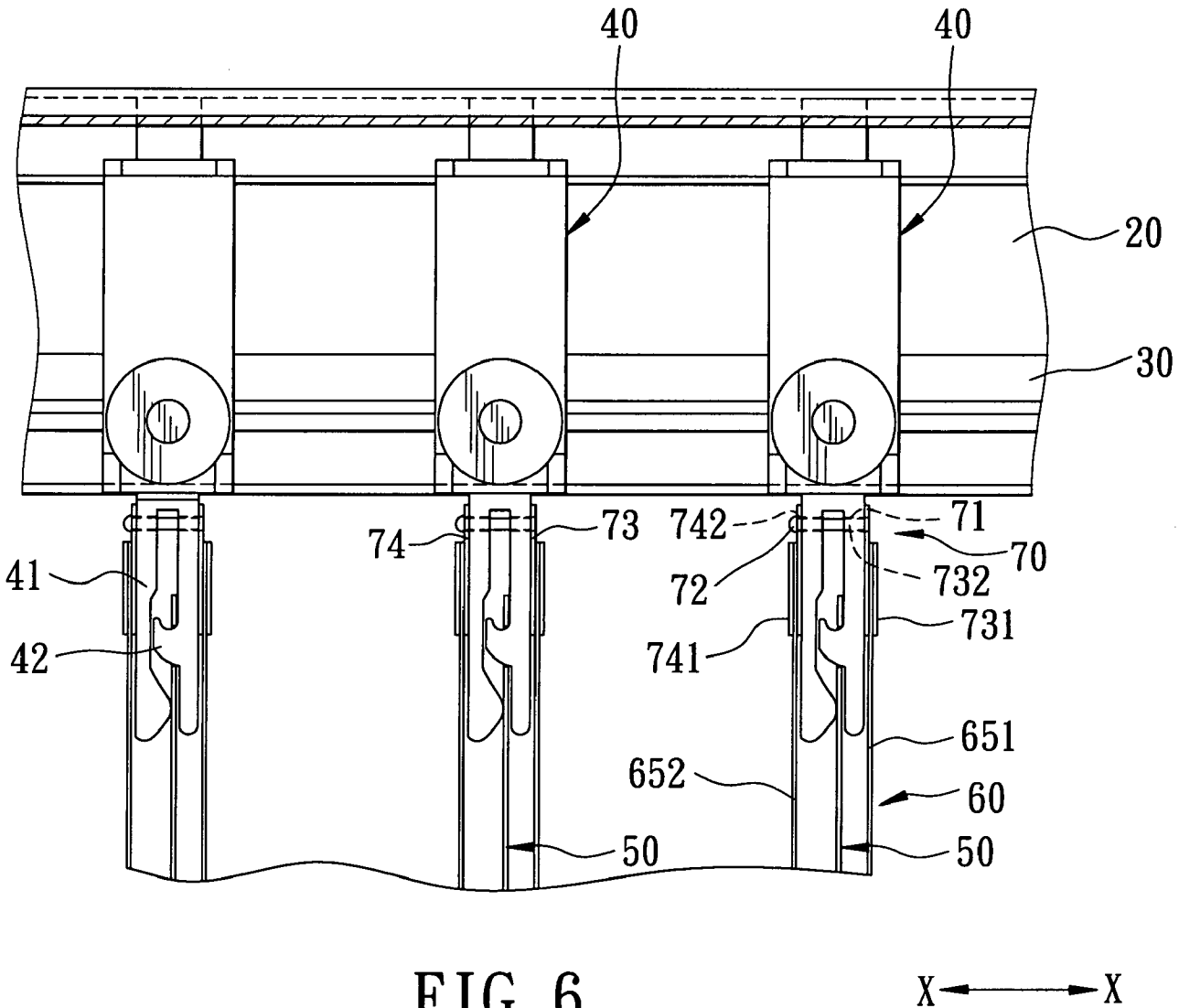
FIG. 6 is a fragmentary, partly sectional view of the preferred embodiment, illustrating three connecting devices.
Figure 7:
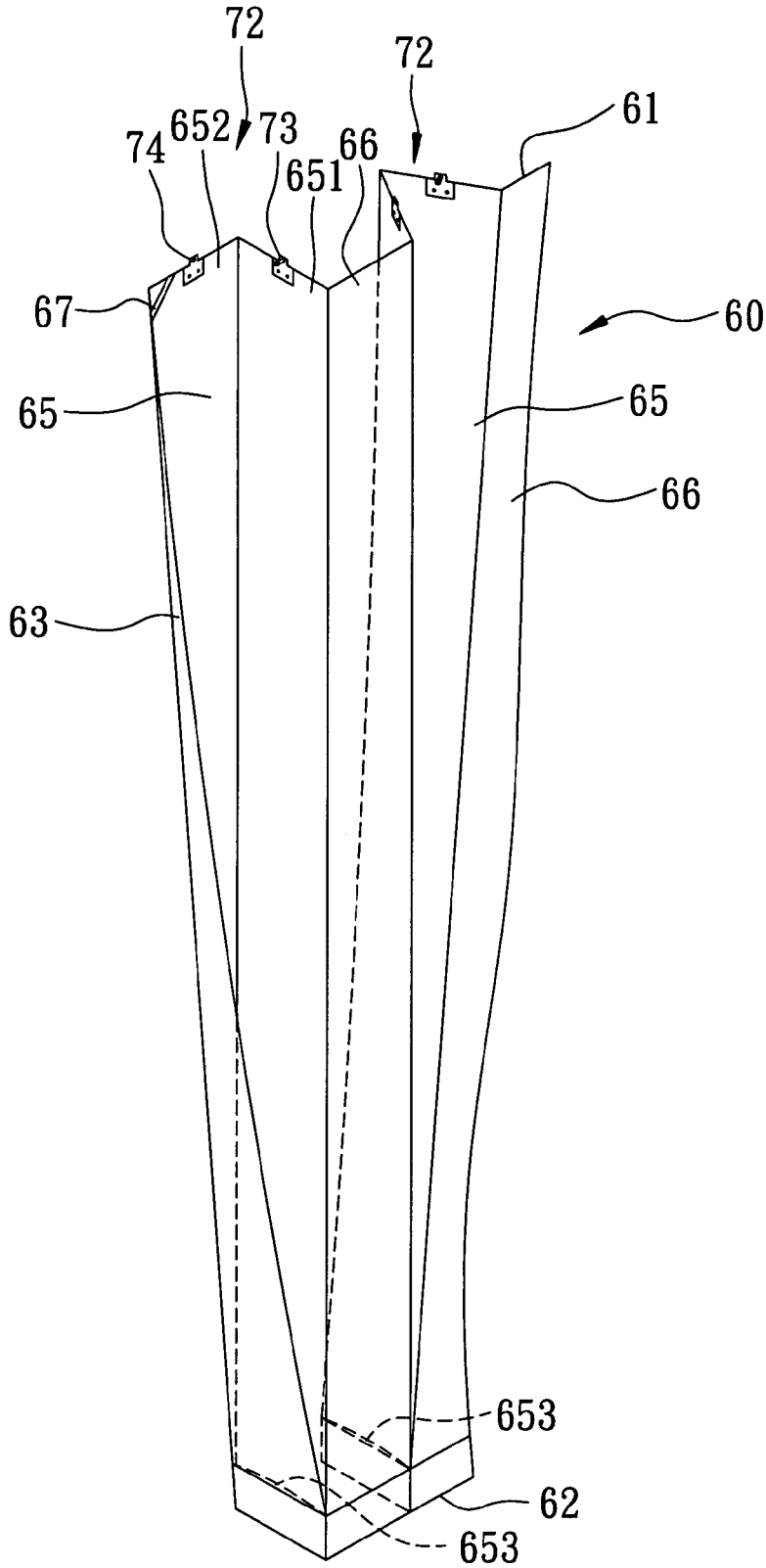
FIG. 7 is a fragmentary, assembled perspective view of the decorative curtain of the preferred embodiment.

Referring to FIGS. 4, 5, and 6, the preferred embodiment of a vertical window blind according to this invention is shown to include a headrail 20, a rotating shaft 30, a plurality of carriers 40, a plurality of vertical slats 50, a decorative curtain 60, and a plurality of connecting devices 70.

The rotating shaft 30 is journalled within the headrail 20, and extends along a longitudinal direction (X) of the headrail 20.

The carriers 40 are disposed in the headrail 20, and are sleeved movably on the rotating shaft 30. As such, the carriers 40 are slidable along the longitudinal direction (X) of the headrail 20. Each of the carriers 40 includes a rod body 41 that extends downwardly from the headrail 20 and that is formed with a retaining hook 42.

Each of the vertical slats 50 has a top portion that is formed with a hole 51. The retaining hooks 42 of the carriers 4 extend respectively through the holes 51 in the vertical slats 50. As such, the vertical slats 50 are hung respectively on the carriers 40, as shown in FIG. 6.

Referring to FIGS. 4, 5, 6, 7, and 8, the decorative curtain 60 includes a curtain body that has a top edge 61, a bottom edge 62, a left side edge 63, a right side edge 64, a plurality of equidistant mounting portions 65, and a plurality of covering portions 66.

The left side edge 63 interconnects the top and bottom edges 61, 62. The right side edge 64 interconnects the top and bottom edges 61, 62, and is opposite to the left side edge 63. The mounting portions 65 are disposed between the left and right side edges 63, 64, and are located respectively under the carriers 40. The covering portions 66 interconnect the mounting portions 65. The mounting portions 65 and the covering portions 66 are alternately arranged along the longitudinal direction (X) of the headrail 20.

Each of the mounting portions 65 has an adjacent pair of first and second panel portions 651, 652 that abut respectively against two opposite side surfaces of the corresponding vertical slat 50. Each of the first and second panel portions 651, 652 has opposite vertical inner and outer sides 650, 650' (see FIG. 5). The inner side 650 of each of the first panel portions 651 is integrally connected to the inner side 650 of the adjacent second panel portion 652. The outer side 650' of each of the first and second panel portions 651, 652 is integrally connected to the adjacent covering portion 66 (except for those constituting the left and right side edges 63, 64). Lower ends of the outer sides 650' of the first and second panel portions 651, 652 of each of the mounting portions 65 are woven together so as to define an annular bottom end 653 of the corresponding mounting portion 65. The vertical slats 50 are inserted respectively into the annular bottom ends 653 of the mounting portions 65.

The decorative curtain 60 further includes an inclined first slat-holding strap 67, and an inclined second slat-holding strap 68. The first slat-holding strap 67 is disposed in proximity to a juncture between the top edge 61 and the left side edge 63, and has an upper end woven to the top edge 61, and a lower end woven to the left side edge 63. A left upper corner of the leftmost vertical slat 50 can be held between the first slat-holding strap 67 and the curtain body. The second slat-holding strap 68 is disposed in proximity to a juncture between the top edge 61 and the right side edge 64, and has an upper end woven to the top edge 61, and a lower end woven to the right side edge 64. A right upper corner of the rightmost vertical slat 50 can be held between the second slat-holding strap 68 and the curtain body.

Each of the connecting devices 70 is connected to a respective one of the carriers 40 and a respective one of the mounting portions 65 of the decorative curtain 60.

Each of the connecting devices 70 includes a first connecting unit 71 disposed at the rod body 41 of the corresponding carrier 40, and a second connecting unit 72 disposed at the corresponding mounting portion 65 of the decorative curtain 60 at a position in proximity to the top edge 61 of the decorative curtain 60 and connected removably to the first connecting unit 71.

The first connecting unit 71 of each of the connecting devices 70 is configured as a hole that is formed through the rod body 41 of the corresponding carrier 40 above the corresponding retaining hook 42.

The second connecting unit 72 of each of the connecting devices 70 includes a retaining pin member 73 and a retaining ring member 74. Each of the retaining pin members 73 includes a plate body 731 secured to the first panel portion 651 of the corresponding mounting portion 65 of the decorative curtain 60, and a retaining pin 732 connected fixedly to the plate body 731. Each of the retaining ring members 74 includes a plate body 741 secured to the second panel portion 652 of the corresponding mounting portion 65 of the decorative curtain 60, and a retaining ring 742 connected fixedly to the plate body 741. The retaining pins 732 extend respectively through the holes 71 of the rod bodies 41 of the carriers 40, and are inserted respectively into the retaining rings 742 so as to interconnect the decorative curtain 60 and the carriers 40. As such, the decorative curtain 60 can be easily mounted to the carriers 40.

Alternatively, in each of the connecting devices 70, the first connecting unit 71 is configured as two retaining pins projecting respectively from two opposite sides of the rod body 41 of the corresponding carrier 40, and the second connecting unit 72 is configured as two retaining rings disposed respectively on the first and second panel portions 651, 652 of the corresponding mounting portion 65 of the decorative curtain 60 and sleeved respectively on the retaining pins of the rod body 41 of the corresponding carrier 40.

Figure 8:
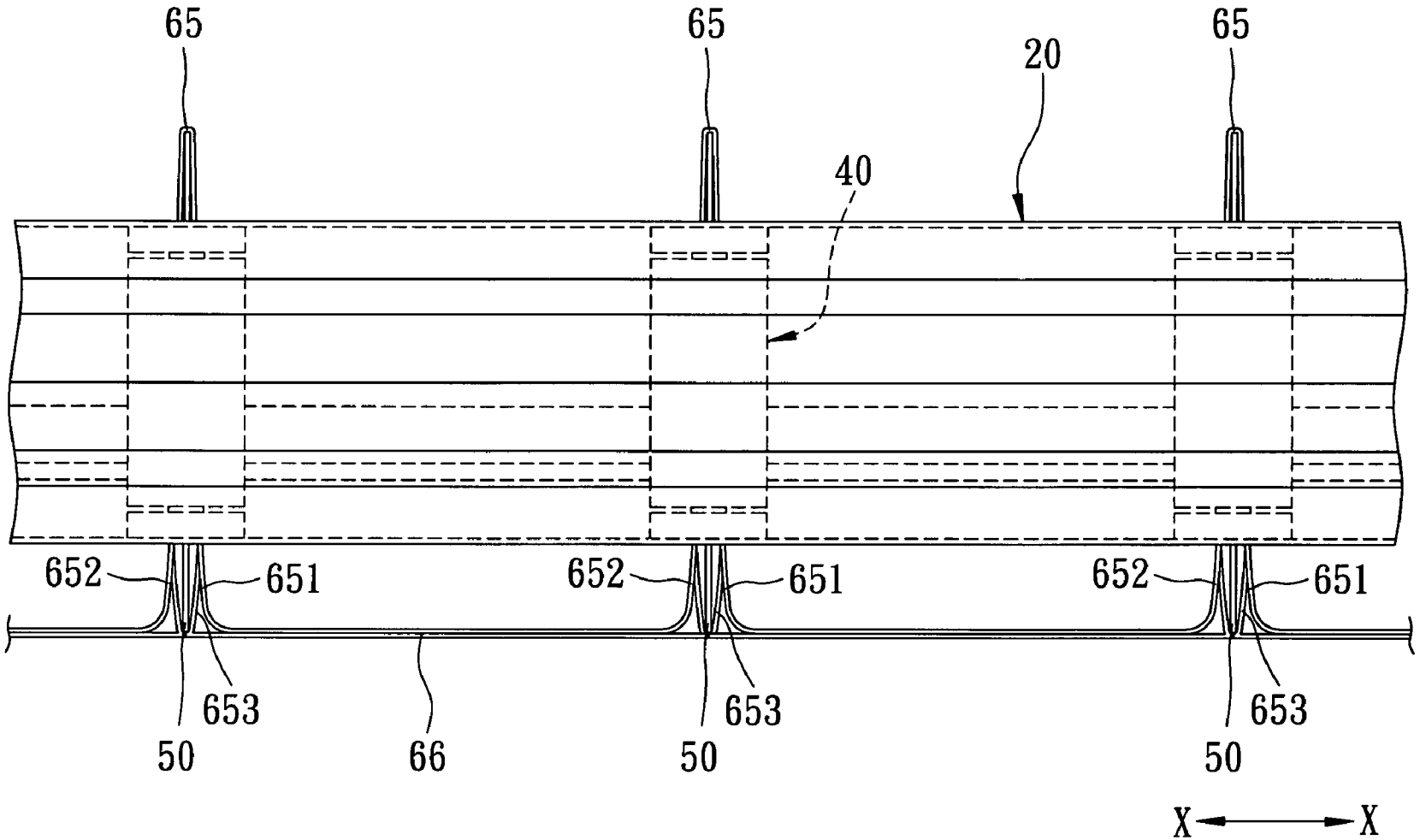
FIG. 8 is a fragmentary top view of the preferred embodiment.

Gaps between the vertical slats 50 are screened completely by the covering portions 66 of the decorative curtain 60, as shown in FIGS. 4 and 8.

The vertical window blind of this invention has the following advantages:

(1) Both of the decorative curtain 60 and an assembly of the vertical slats 50 can be mounted alone to the carriers 40 (i.e., the mounting of one does not depend on the mounting of the other).

(2) The decorative curtain 60 can be easily mounted to the carriers 40.

(3) Because the weight of the decorative curtain 60 is not applied to the vertical slats 50, undesired detachment of the vertical slats 50 from the carriers 40 can be prevented.

With this invention thus explained, it is apparent that numerous modifications and variations can be made without departing from the scope and spirit of this invention. It is therefore intended that this invention be limited only as indicated by the appended claims.

I claim:

1. A vertical window blind comprising:

a headrail;

a plurality of carriers disposed slidably in said headrail and slidable along a longitudinal direction of said headrail, each of said carriers including a rod body extending downwardly from said headrail;

a decorative curtain including a curtain body that has a top edge, a bottom edge, a left side edge interconnecting said top and bottom edges, and a right side edge interconnecting said top and bottom edges and opposite to said left side edge, a plurality of equidistant mounting portions disposed between said left and right side edges and located respectively under said carriers, and a plurality of covering portions interconnecting said mounting portions, said mounting portions and said covering portions being alternately arranged along the longitudinal direction; and a plurality of connecting devices, each of which is connected to a respective one of said carriers and a respective one of said mounting portions of said curtain body of said decorative curtain, each of said connecting devices including a first connecting unit disposed at said rod body of a corresponding one of said carriers, and a second connecting unit disposed at a corresponding one of said mounting portions of said curtain body of said decorative curtain at a position in proximity to said top edge of said curtain body of said decorative curtain and connected removably to said first connecting unit;

wherein said rod body of each of said carriers includes a retaining hook, said vertical window blind further comprising a plurality of vertical slats, each of which has a top portion that is formed with a hole, said retaining hooks of said rod bodies of said carriers extending respectively through said holes in said top portions of said vertical slats;

wherein each of said mounting portions of said curtain body of said decorative curtain has an adjacent pair of first and second panel portions that abut respectively against two opposite side surfaces of a corresponding one of said vertical slats, each of said first and second panel portions having opposite vertical inner and outer sides, said inner side of each of said first panel portions being integrally connected to said inner side of an adjacent one of said second panel portions, said outer side of each of said first and second panel portions being integrally connected to an adjacent one of said covering portions of said curtain body of said decorative curtain;

wherein said first connecting unit of each of said connecting devices is configured as a hole that is formed through said rod body of the corresponding carriers above a corresponding one of said retaining hooks, said second connecting unit of each of said connecting devices including a retaining pin secured to said first panel portion of the corresponding one of said mounting portions of said curtain body of said decorative curtain, and a retaining ring secured to said second panel portion of the corresponding one of said mounting portions of said curtain body of said decorative curtain, said retaining pins extending respectively through said holes in said rod bodies of said carriers and being inserted respectively into said retaining rings so as to interconnect said decorative curtain and said carriers.

2. The vertical window blind as claimed in claim 1, wherein lower ends of said outer sides of said first and second panel portions of each of said mounting portions of said curtain body of said decorative curtain are woven together so as to define an annular bottom end of the corresponding one of said mounting portions of said curtain body of said decorative curtain, said vertical slats being inserted respectively into said annular bottom ends of said mounting portions of said curtain body of said decorative curtain.

* * * * *